United States Patent [19]

Rossi

[11] 4,070,149

[45] Jan. 24, 1978

[54] CONTROLLABLE DISTRIBUTION SYSTEM FOR ROTARY KILN

[75] Inventor: Eugene F. Rossi, Wauwatosa, Wis.

[73] Assignee: Allis-Chalmers Corporation, Milwaukee, Wis.

[21] Appl. No.: 708,135

[22] Filed: July 23, 1976

[51] Int. Cl.[2] ..... F27B 7/36

[52] U.S. Cl. ..... 432/109; 266/96

[58] Field of Search ..... 432/105, 109, 103; 266/96

[56] References Cited

U.S. PATENT DOCUMENTS

| | | | |
|---|---|---|---|
| 2,091,850 | 8/1937 | Gohre | 432/109 |
| 3,182,980 | 5/1965 | Helfrich | 432/109 |
| 3,784,107 | 1/1974 | Rossi | 239/600 X |
| 3,794,483 | 2/1974 | Rossi | 432/109 |
| 3,847,538 | 11/1974 | Rossi | 432/113 |
| 3,945,624 | 3/1976 | Rossi | 266/96 |

*Primary Examiner*—John J. Camby

*Attorney, Agent, or Firm*—John P. Hines

[57] ABSTRACT

Apparatus for controlling the delivery of fuel and air to a rotary reduction kiln wherein both the fuel and air flow through the same fluid distribution nozzle. Separate fuel and air valves control the flow through the nozzles. Two separate means are provided about the kiln for operating each valve as the kiln rotates. Each of these means is individually adjustable to a first position where the valve setting is sequentially altered as the kiln rotates and to a second position where the valve setting is unaltered as the kiln rotates.

1 Claim, 5 Drawing Figures

CONTROLLABLE DISTRIBUTION SYSTEM FOR ROTARY KILN

BACKGROUND OF THE INVENTION

This invention relates to rotary kilns used for such purposes as reducing iron ore to a lower state of oxidation having nozzles mounted on the outer surface of the kiln projecting radially through the kiln shell and including central means adapted to alternately inject both air and fuel into the kiln through the same nozzles. In particular the invention relates to such a rotary kiln wherein the control means is capable of adjustment to vary the time interval air and fuel are admitted through the nozzles while the kiln rotates.

In prior art rotary kilns are known wherein a plurality of nozzles are provided through the shell of the kiln to admit air and fuel into the interior or ore reduction chamber of the kiln. A charge of ore is provided in the reduction chamber and it is reduced to a higher state of iron.

Examples of such prior art kilns are disclosed in U.S. Pat. Nos. 1,216,667 issued Feb. 20, 1917, 2,091,850 issued Aug. 31, 1937 and 3,182,980 issued May 11, 1965.

In the prior art kilns fuel and air are delivered through the nozzles by piping supported on the exterior of the kiln or on the interior of the kiln. This piping is connected to the nozzles for injecting the fuel and air into the reduction chamber. In most prior art patents a mixture of both fuel and air has been admitted through the nozzles at the same time or fuel is admitted through one nozzle and air admitted through a different nozzle.

In certain instances it is desirable to admit only one fuel through a nozzle when it is beneath the charge and only the other fuel when the nozzle is above the charge. As an example it is desirable in certain instances to admit fuel to the reduction chamber through nozzles as they pass directly beneath the bed of the charge whereby the fuel flows directly into the charge. When this nozzle has moved beyond the bed of the charge the fuel is shut off and no fluid is passing through the nozzle. At the same time air is admitted to the reduction chamber above the charge through additional nozzles. Before these air nozzles pass beneath the bed the air is turned off so that no fluid passes through these nozzles as they pass beneath the bed. This arrangement is shown in U.S. Pat. No. 3,182,980.

From the above it can be seen that quite a large number of nozzles are required. It was not unusual to have as many as 300 nozzles in a rotary kiln of a 150 foot length. Furthermore these nozzles are exposed to extremely high temperatures in the range of 2,000 degrees Fahrenheit. While the fluid is flowing through a nozzle the fluid itself has a tendency to cool the nozzle. However, when no fluid is passing through the nozzle it approaches the temperature within the reduction chamber thereby reducing the effective life of the nozzle.

Applicant thereby determined that it would be desirable to provide a process wherein both fuel and air are admitted through the same nozzles at different points of rotation of the kiln. This process and apparatus for practicing the process are disclosed in U.S. Pat. Nos. 3,794,483 and 3,847,538.

When the kiln is initially being heated to the desired temperature, it is advantageous to admit air through all of the nozzles during the full rotation of the kiln. This flow of air cools the nozzles and helps to keep them clean. Apparatus for operating the kiln in this manner is disclosed in U.S. Pat. No. 3,945,624.

It has subsequently been determined that it is desirable to have a control system for a kiln of the hereinabove described type which is more flexible in operation than the control systems of the prior art. Such a system will provide structure to permit: (1) air only through all nozzles; (2) fuel only through all nozzles; (3) alternate delivery of air and fuel through the same nozzles at different rotational positions of the nozzles relative to the location of the bed of ore in the kiln; and combinations of the above.

It is, therefore, the intent and general object of this invention to provide a control system for a rotary kiln having nozzles through which both fuel and air flow that is more flexible in operation than prior art control systems for such kiln.

An additional object of the subject invention is to provide a control system for a rotary kiln wherein both fuel and air pass through the same nozzles with a separate shut-off valve for both the air supply and the fuel supply.

A more specific object of the subject invention is to provide a control system for a kiln of the hereinbefore described type which is adjustable to selectively engage or not engage each of the air and fuel valves as the kiln rotates.

These and other objects of the subject invention will become more fully apparent as the following description is read in light of the attached drawings wherein.

Figure 1:
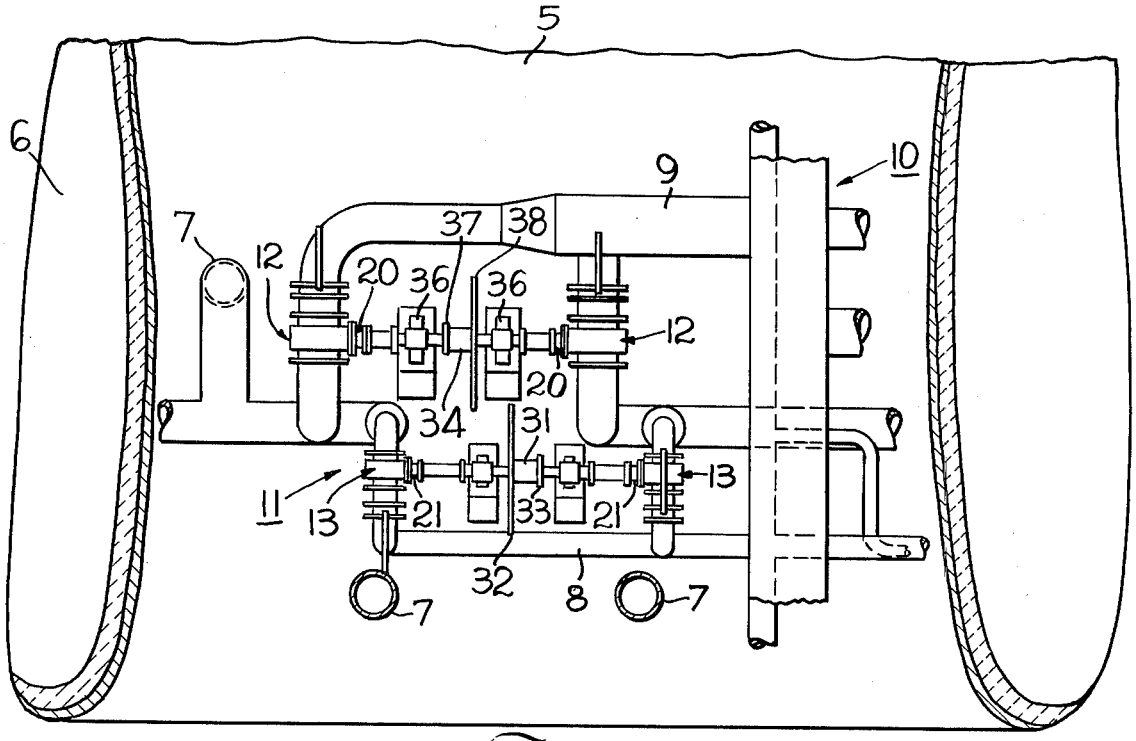
FIG. 1 is a side elevation view of a portion of a kiln and kiln control system constructed in accordance with the invention.
Figure 2:
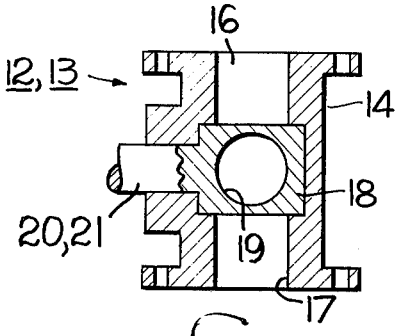
FIG. 2 is a cross sectional view of a typical type of shut-off valve which can be utilized in connection with this invention in the "off" position.
Figure 3:
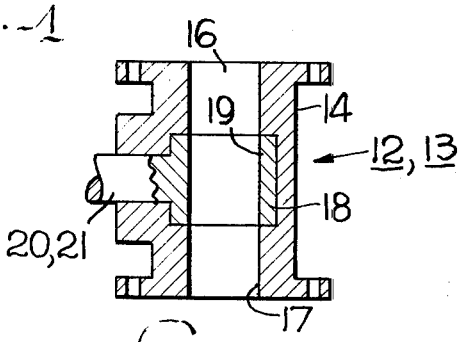
FIG. 3 is a cross sectional view of the same valve as FIG. 2 shown in the open position.

Referring to the attached drawings, and particularly FIGS. 1, 2 and 3, the kiln shown herein for purposes of illustration is provided with an elongated cylindrical body portion 5 which defines a cylindrical reduction or combustion chamber 6. The shell or inner wall of the kiln may be constructed of any suitable refractory material such as firebricks. Any well known means may be provided for supporting and rotating the kiln. Since such means form no part of this invention and are well known in the art, they are not shown herein.

A plurality of circumferentially and axially spaced nozzles 7 are provided about the surface of the kiln opening into the reduction chamber. These nozzles may be constructed in accordance with applicant's U.S. Pat. No. 3,784,107 issued Jan. 8, 1974 and assigned to the same assignee as this invention. The nozzles may be supported by the outer kiln plate as is shown in the immediately above-identified patent.

A plurality of circumferentially spaced fuel and air conduits 8 and 9, respectively, are also supported about the outer surface of the kiln. Any conventional means in the form of a manifold 10 may be provided to deliver fuel and air to the conduits 8 and 9, respectively. A fuel distribution means generally designated 11 connects the respective fuel and air conduits to the associated nozzles. The fuel distribution means includes a plurality of air valves 12 and a plurality of fuel valves 13. These valves are selectively operable between open and closed positions to permit and interrupt the flow of fluid through the conduits to the nozzles 7.

The particular valves 12 and 12 shown herein for purposes of illustration are more clearly defined in FIGS. 2 and 3. Each valve consists of a valve body 14 having an inlet port 16 and an outlet port 17. A rotary plug 18 having a passage 19 therethrough is rotatably supported in the valve body. The valve 12 has a valve stem 20 attached thereto and extending to the exterior of the valve body and the valve 13 has a valve stem 21 attached thereto and extending to the exterior of the valve body. The plug 18 is rotatable to an "off" position shown in FIG. 2 which blocks the flow of fluid through the valve and to an "on" position shown in FIG. 3 which permits the flow of fluid through the valve.

Prior to commencing the reduction process and the admission of fuel to the reduction chamber, it is necessary to preheat the kiln to operating temperature. This is accomplished by rotating the kiln as a main burner (not shown) heats the reduction chamber. During this preheating operation, it is advantageous to admit air or gas through all nozzles 7. The air or gas keeps the nozzles clean and cool. The gas may be used to assist the main burner during perheating of the kiln. Once the kiln has attained the proper operating temperature, it is then desirable to admit fuel from conduit 8 only through those nozzles that are beneath the ore charge and air from conduit 9 only through those nozzles that are above the ore charge. To this end, cams and trip means are strategically located to provide this variable operation of the valves 12 and 13.

Figure 4:
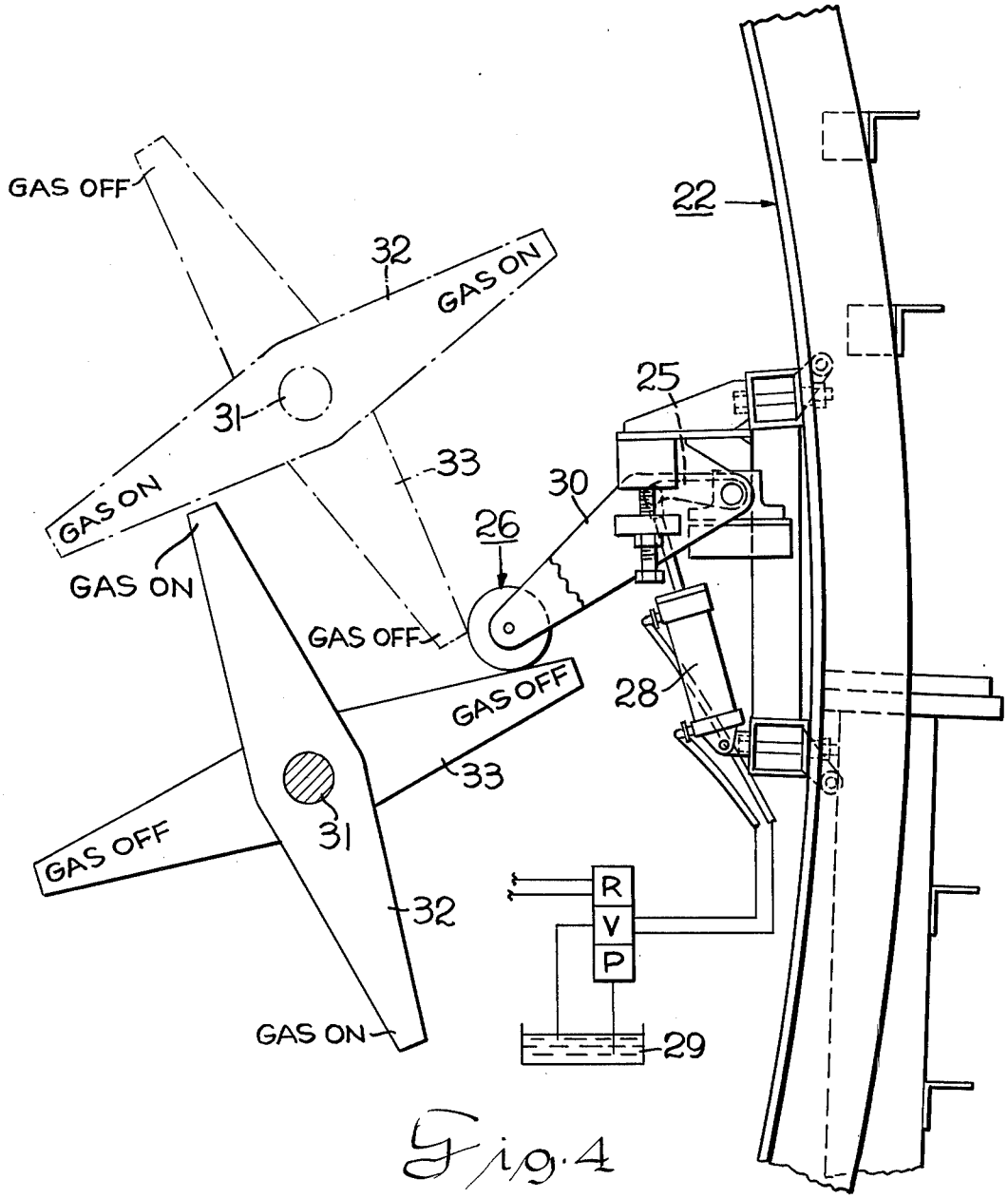
FIG. 4 is a detailed end view showing the operating sequence of the gas "on" and "off" cams with the gas-off tripper mechanism.
Figure 5:
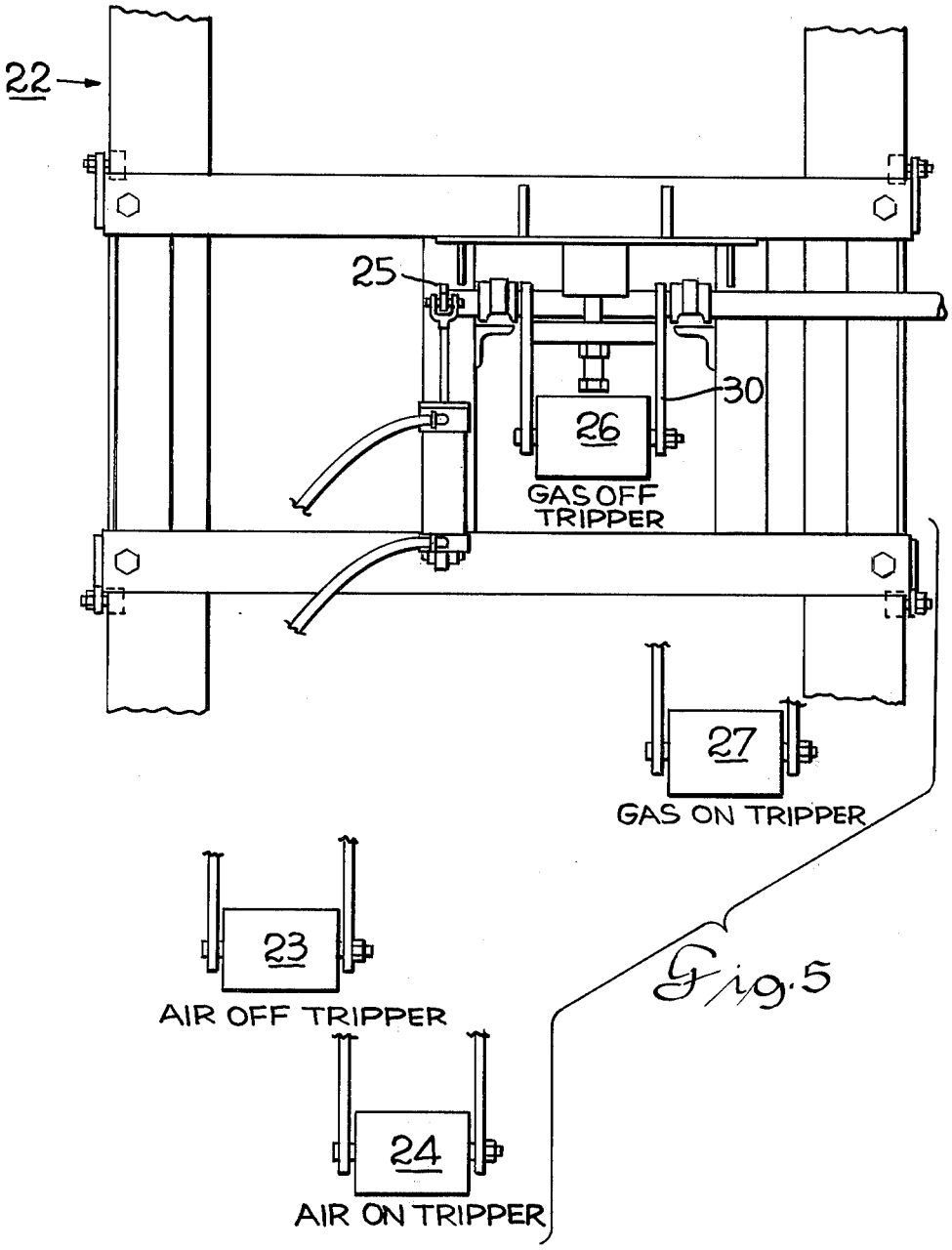
FIG. 5 is a partial development showing the cam tripper sequence.

Referring particularly to FIGS. 4 and 5 a frame generally designated 22 is located about the kiln. Four strategically located cam trip means 23, 24, 26 and 27 are connected to the frame 22. Each of these trip means is adjustable to permit movement thereof between cam engaging and cam nonengaging positions. Such adjusting means are herein shown for purposes of illustration in the form of a separate hydraulic servomotor 28 connected to each trip 23, 24, 26 and 27. Each servomotor casing is pivotally connected to the frame 22 and the servomotor piston rod is connected to a rocker arm 25. Each rocker arm 25 is rigid with a bifurcated lever arm 30 having one end pivotally connected to the frame 22 and the other end rotatably supporting the cam trippers 23, 24, 26 and 27. Each servomotor is operated by a control valve V which in turn is activated by an electrical relay R controlled from a remote source. A pump P is provided to pressurize the fluid from a sump 29.

Each fuel valve stem 21 is connected to a cam shaft 31 which is rotatably supported on the periphery of the kiln surface. The fuel cam shaft 31 has a pair of axially spaced cams 32 and 33 connected thereto for rotation therewith. Each cam is in effect a plate having oppositely disposed trip engaging surfaces. One cam 32 is for opening the valves 13 and the other cam 33 is for closing the valves 13. Each "on" and "off" cam has two trip engaging surfaces in order to properly index the cams as will be apparent as the operation of the mechanism is described later.

Each air valve stem 20 is connected to an air cam shaft 34 which is rotatably supported in bearing brackets 36 connected to the exterior of the kiln 6. The air cam shaft is also provided with a pair of axially spaced air cams 37 and 38 for opening and closing, respectively, the air valves 12. As is the case with the fuel cams, each air cam is also provided with a pair of oppositely disposed trip engaging surfaces. Each of the four cams 32, 33, 37 and 38 are in axially spaced planes.

The operation of the apparatus will now be described.

The external valves (not shown) for the air and fuel are turned on so that air is in the conduit 9 and fuel is in the conduit 8. In order to preheat the kiln, the main burner (not shown) is ignited inside the reduction chamber. The relay R for the gas "on" trip 27 is activated to remove that trip to the cam nonengaging position. In such position the gas "on" servomotor piston rod will move into the servomotor cylinder pivoting the gas "on" lever arm 30 downward and withdrawing the gas "on" trip 27 from the rotational path of the gas "on" cam 32. The gas "off" trip 26 is in the cam engaging position (as shown in FIG. 4) so that as the kiln rotates, the gas "off" trip moves the gas "off" cam to the valve closing position and no fuel is permitted to pass through the gas valves 13 into the nozzles 7. The proper relay R is activated to move the air "off" trip 23 to the cam disengaging position while the air "on" trip is in the cam engaging position. In this manner, as the kiln rotates, the air "on" cam moves the air valves 12 to the open condition permitting air to flow into the reduction chamber.

Once the kiln has been heated to the desired temperature, the main burner (not shown) may be turned off. The proper relays R are then activated so that all of the trips 23, 24, 26 and 27 are in the cam engaging positions. Referring particularly to FIG. 4 and using the gas "on" and "off" cams as an example, as the kiln rotates, the gas "off" cam contacts the gas "off" trips 26. As the kiln continues to rotate, the gas "off" cam is rotated to the top position shown in phantom lines which indexes the gas "on" cam (which is connected to the same cam shaft 31) for proper engagement by its associated trip as the kiln rotates. The cams and the trips are strategically located relative to one another so that gas only flows through those nozzles that are beneath the ore charge (not shown) in the reduction chamber and air only flows through those nozzles that are above the ore charge.

If it is desired to provide additional heat to the reduction chamber, gas only may be provided through all nozzles during full rotation of the kiln. This can be accomplished by activating the connected relay R so that the air "on" trip 24 is retracted to the cam disengaging position. At the same time, the connected relay R is activated to withdraw the gas "off" trip 26 to the disengaged position. In this manner, as the kiln rotates, the air "off" trip 23 will activate its associated cam 38 turning the air valve 12 off. As the air valve is turned off, the air "on" cam is indexed for engagement with the air "on" trip. However, since the air "on" trip is retracted, the air valve will remain in the "off" position until the air "on" trip is again moved to the cam engaging position. At the same time, since the gas "off" trip has been moved to the disengaged position, the gas "on" cam will engage the gas "on" trip moving the gas valve to the open position permitting gas to flow through the nozzles 7. The gas valve will remain in this open position until the gas "off" trip is again moved to the cam engaging position.

It is also possible by proper manipulation of the relays R and placement of the cam trips to permit both gas and air to flow through all the nozzles or to interrupt the flow of both gas and air through all nozzles. Once it is desired to again operate the kiln in the desired manner by permitting gas to flow through those nozzles beneath the charge and air through those nozzles above the charge, all trips are moved to the cam engaging positions. As the kiln rotates, the cams are properly indexed so that the valves are turned on and off to effect the desired alternate flow of air and fuel through the nozzles.

From the above description, it can be seen that a very versatile control mechanism has been provided for a rotary kiln of the type described herein. A great variety of control operation and special control patterns can be effected with this mechanism.

The embodiments of the invention in which an exclusive property is claimed are defined as follows:

1. A rotary kiln comprising:

an elongated cylindrical ore reduction chamber;

a nozzle supported by and rotating with said kiln in fluid communication with said chamber;

fuel and gas conduit means supported on said kiln for rotation therewith;

gas valve means associated with said nozzle and said gas conduit means selectively operable to permit and interrupt the flow of gas from said gas conduit through said nozzle into said chamber;

fuel valve means associated with said nozzle and said fuel conduit means selectively operable to permit and interrupt the flow of fuel from said fuel conduit through said nozzle into said chamber;

axially spaced gas "on" and "off" cams supported on said kiln connected together and to said gas valve for selective "on" and "off" operation thereof as said cams are rotated:

axially spaced fuel "on" and "off" cams supported on said kiln connected together and to said fuel valve for selective "on" and "off" operation thereof as said cams are rotated, said fuel "on" and "off" cams being axially spaced from said gas "on" and "off" cams;

four trip means supported about said kiln in axially spaced planes coincident with the planes of said "on" and "off" cams for selective engagement by and rotation of a coplaner cam as said kiln rotates, said cam and said trip means being arranged whereby each connected "on" and "off" cam must sequentially engage its associated trip to index the other connected cam to engage its associated trip; and means connected to each of said trip means operable to selectively move said trip means into and out of position for engagement by its associated cam.

* * * * *